US008096777B2

(12) United States Patent
Yokoyama et al.

(10) Patent No.: US 8,096,777 B2
(45) Date of Patent: Jan. 17, 2012

(54) MIXED FLOW TURBINE OR RADIAL TURBINE

(75) Inventors: Takao Yokoyama, Nagasaki (JP); Hirotaka Higashimori, Nagasaki (JP); Motoki Ebisu, Sagamihara (JP); Takashi Shiraishi, Sagamihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 950 days.

(21) Appl. No.: 11/989,934

(22) PCT Filed: Feb. 9, 2007

(86) PCT No.: PCT/JP2007/052355

§ 371 (c)(1),
(2), (4) Date: Feb. 4, 2008

(87) PCT Pub. No.: WO2008/062566

PCT Pub. Date: May 29, 2008

(65) Prior Publication Data

US 2010/0098548 A1 Apr. 22, 2010

(30) Foreign Application Priority Data

Nov. 20, 2006 (JP) ..... 2006-312800

(51) Int. Cl.
*F01D 5/14* (2006.01)

(52) U.S. Cl. ..... 416/223 R; 416/242; 416/243

(58) Field of Classification Search ..... 416/223 R, 416/242, 243
See application file for complete search history.

(56) References Cited

U.S. PATENT DOCUMENTS

| | | | | |
|---|---|---|---|---|
| 3,333,817 | A * | 8/1967 | Rhomberg | 416/242 |
| 3,464,357 | A * | 9/1969 | Gilbert et al. | 415/193 |
| 4,791,784 | A * | 12/1988 | Minardi et al. | 416/242 |
| 2004/0105756 | A1 | 6/2004 | Higashimori et al. | |

FOREIGN PATENT DOCUMENTS

| | | |
|---|---|---|
| JP | 55-134797 | 10/1980 |
| JP | 11-190201 | 7/1999 |
| JP | 2002-364302 | 12/2002 |
| JP | 2003-148101 | 5/2003 |
| JP | 2004-092498 | 3/2004 |

* cited by examiner

*Primary Examiner* — Igor Kershteyn
(74) *Attorney, Agent, or Firm* — Wenderoth, Lind & Ponack, L.L.P.

(57) ABSTRACT

A mixed flow turbine or radial turbine suppresses a rapid increase in load applied on a leading edge of a blade, and can reduce incidence loss. The mixed flow turbine or radial turbine includes a hub, and a plurality of blades provided on an outer circumference surface of the hub at substantially equal intervals. The camber line of the blade section is convex-curved to the rotational direction side as seen entirely from a leading edge side toward trailing edge side. On a leading edge section of the blade, there is provided an inflected section that is inflected so that a camber line in a sectional surface along the outer circumference surface is concave-curved to the rotational direction side.

12 Claims, 7 Drawing Sheets

MIXED FLOW TURBINE OR RADIAL TURBINE

TECHNICAL FIELD

The present invention relates to a mixed flow turbine or a radial turbine used in a small gas turbine, a turbocharger, an expander, and the like.

BACKGROUND ART

In this type of turbine, a plurality of blades is disposed in a radial pattern on the outer circumference of a hub as disclosed for example in Patent Document 1.

The efficiency of a turbine is shown with respect to a theoretical velocity ratio (=U/C0) being a ratio of peripheral velocity U of the blade inlet, to a maximum flow velocity of a working fluid (gas) accelerated by the turbine entry temperature and its compression ratio, that is, a theoretical velocity C0.

A radial turbine has a certain theoretical velocity ratio U/C0 where its efficiency reaches a peak. The theoretical velocity C0 is changed by changes in the state of the gas, such as changes in gas temperature and gas pressure.

When the theoretical velocity C0 changes, the inflow angle of the gas that flows in to a leading edge of the blade changes, and thus the angular difference between the leading edge and gas inflow angle becomes greater.

When the angular difference between the leading edge and the gas inflow angle becomes greater in this way, the inflowing gas separates at the leading edge and collision loss becomes greater, resulting in the occurrence of incidence loss.

On the other hand, in a mixed flow turbine as shown in FIGS. 13(*a*) and (*b*), a blade 101, seen from a sectional surface 105 along the outer circumference surface of a hub 103, is generally configured such that a camber line (center line of the blade thickness) 107 has a curved shape convexed toward a rotational direction 109 side.

Therefore, since a shape that follows the flow of gas flowing in on the blade angle α of a leading edge 102, in other words, a shape that allows the blade angle α to match the relative flow angle β, is possible, then for example the blade angle a may be such as to reduce incidence loss at a low theoretical velocity ratio (low U/C0).

Thus, if the efficiency at low U/C0 can be improved, the outline shape of the mixed flow turbine can be suppressed, which is effective for response.

Patent Document 1: Japanese Unexamined Patent Application, Publication, No. 2002-364302

SUMMARY OF THE INVENTION

Incidentally, a gas flow field in a mixed flow turbine is basically formed by a free vortex. Therefore, for example, the absolute circumferential flow velocity Cu is inversely proportional to the radial position as shown in FIG. 3. On the other hand, since the peripheral velocity U of the blade 101 is proportional to the radial position, a relative circumferential flow velocity Wu occurs between the gas flow and the blade 101.

Plotting the relative circumferential flow velocity Wu against the radial position yields a curved line that is convex-curved downward (convex curved in the counter-rotational direction) as shown in FIG. 4. In other words, the rate of change toward the rotational direction becomes greater as the radial direction position becomes smaller, that is to say, there is a rate of change toward the rotational direction.

FIG. 5 schematically shows the changing trajectory of the relative flow velocity at this time. The relative flow velocity W is the synthesis of the relative circumferential flow velocity Wu that changes according to FIG. 4, and the substantially constant relative radial velocity Wr. The change in the size in the relative flow velocity W has a trend similar to that of the relative circumferential flow velocity Wu shown in FIG. 4.

The angle formed between the relative flow velocity W and the relative circumferential flow velocity Wu is a relative flow angle β at that radial position.

Even if the blade angle α of the leading edge is aligned with the relative flow angle β (that is to say, the leading edge is matched with the trajectory of the relative flow velocity W), the distance therebetween rapidly increases downstream from the leading edge, since the relative flow velocity W is convex-curved in the counter-rotational direction while the camber line 107 of the blade 101 is convex-curved in the rotational direction (in other words, the rate of change of the blade angle α in the rotational direction becomes smaller as the radial direction position becomes smaller, that is to say, there is a rate of change toward the rotational direction). Since the distance between them, that is, the load Fc applied on the blade, rapidly increases, this load gives rise to a leakage flow from a pressure surface side to a suction surface side, and incidence loss occurs.

Moreover, when the gas inflow angle changes in response to changes in the theoretical velocity C0, the inflowing gas separates at the leading edge, so that collision loss becomes greater and incidence loss occurs.

In consideration of the above problems, an object of the present invention is to provide a mixed flow turbine or a radial turbine that suppresses a rapid increase in load applied on the leading edge of the blade, and that can reduce incidence loss.

In order to solve the above problems, the present invention employs following solutions.

That is to say, the present invention provides a mixed flow turbine or a radial turbine comprising a hub, and a plurality of blades provided on an outer circumference surface of the hub at substantially equal intervals, the camber line of the blade section being convex-curved to the rotational direction side as seen entirely from a leading edge side toward trailing edge side, wherein on a leading edge section of the blade, there is provided an inflected section that is inflected so that a camber line in a sectional surface along the outer circumference surface is concave-curved to the rotational direction side.

As described above, on the leading edge of the blade, there is provided the inflected section that is inflected so that the camber line in the section surface along the outer circumference surface of the hub is concave-curved to the rotational direction side. As a result, in the inflected section, the rate of change of the blade angle in the rotational direction becomes greater as the radial direction position becomes smaller, that is to say, it has a rate of change toward the rotational direction.

Therefore, in the case where the blade angle of the leading edge is aligned with the relative flow angle (that is to say, in the case where the leading edge is matched with the trajectory of the relative flow velocity), the blade angle in the inflected section changes to substantially follow the changes in the relative flow velocity. As a result, the distance between the blade surface and the relative flow velocity can be made small, and a rapid increase can be suppressed.

Therefore, a rapid increase in the load on the blade at the leading edge section can be prevented so that occurrence of leak flow from the pressure surface side to the suction surface side due to this load can be suppressed, and incidence loss can be reduced.

Furthermore, in the above invention, it is preferable that, on a leading edge section when the blade is projected onto a cylindrical surface, there be provided an inflected section that is inflected so that the camber line is concave-curved to the rotational direction side.

Moreover, in the above invention, it is preferable that, at least on an upstream side outer surface and/or on a downstream side outer surface in the rotational direction of the inflected section, there is provided a thickened section that smoothly increases the blade thickness from the leading edge.

As described above, on at least the upstream side outer surface and/or the downstream side outer surface in the rotational direction of the inflected section there is provided the thickened section that smoothly increases the blade thickness from the leading edge. As a result, tangent line angles formed by the tangent lines at the ends on the upstream side and the downstream side of the leading edge become greater.

In the case where the tangent line angle of the leading edge becomes greater, and the blade thickness increases smoothly, even if the inflow angle of the working fluid is significantly different from the angle of the camber line, the working fluid can be moved along the outer surface, so that separation of the working fluid on the leading edge can be prevented. Therefore, collision loss can be suppressed and incidence loss can be reduced.

Accordingly, incidence loss with respect to a wide range of theoretical velocity ratios (U/C0) can be reduced.

It is preferable that the thickened section be smoothly decreased after the smooth increase so that the working fluid can flow smoothly and can be prevented from separating after the smooth increase.

Moreover, in the above invention, it is preferable that the inflected section be configured so that a curvature of the camber line becomes smaller as it gets closer to an outer diameter side from the hub side.

The rate of change of the relative flow velocity W toward the rotational direction becomes greater as the radial direction position becomes smaller, that is to say, since it has a rate of change toward the rotational direction, the smaller the radial direction position becomes, that is to say, the closer to the hub side, the greater the rate of change becomes.

According to the present invention, the inflected section is configured such that the curvature of the camber line becomes smaller closer to the outer diameter side from the hub side. As a result, the load applied on the blade surface can be significantly reduced on the hub side, where the load is significant, while the load reduction rate gradually decreases toward the outer diameter side, where the load is smaller.

Therefore, the load Fr in the height direction of the blade can be made substantially uniform, and an incidence loss increase due to unbalanced load can be suppressed.

As a result, incidence loss can be reduced across the entire region in the height direction of the blade.

According to the present invention, on the leading edge of the blade there is provided the inflected section that is inflected so that the camber line on the section surface along the outer circumference surface of the hub is concave-curved to the rotational direction side. Therefore a rapid increase in load applied to the blade at the leading edge section can be prevented.

The occurrence of a leak flow from the pressure surface side to the suction surface side due to this load can be suppressed, and incidence loss can be reduced.

BRIEF DESCRIPTION OF DRAWINGS

FIG. 3 is a graph showing states of a flow field in a mixed flow turbine or the like.

EXPLANATION OF REFERENCE SIGNS

Figure 1:
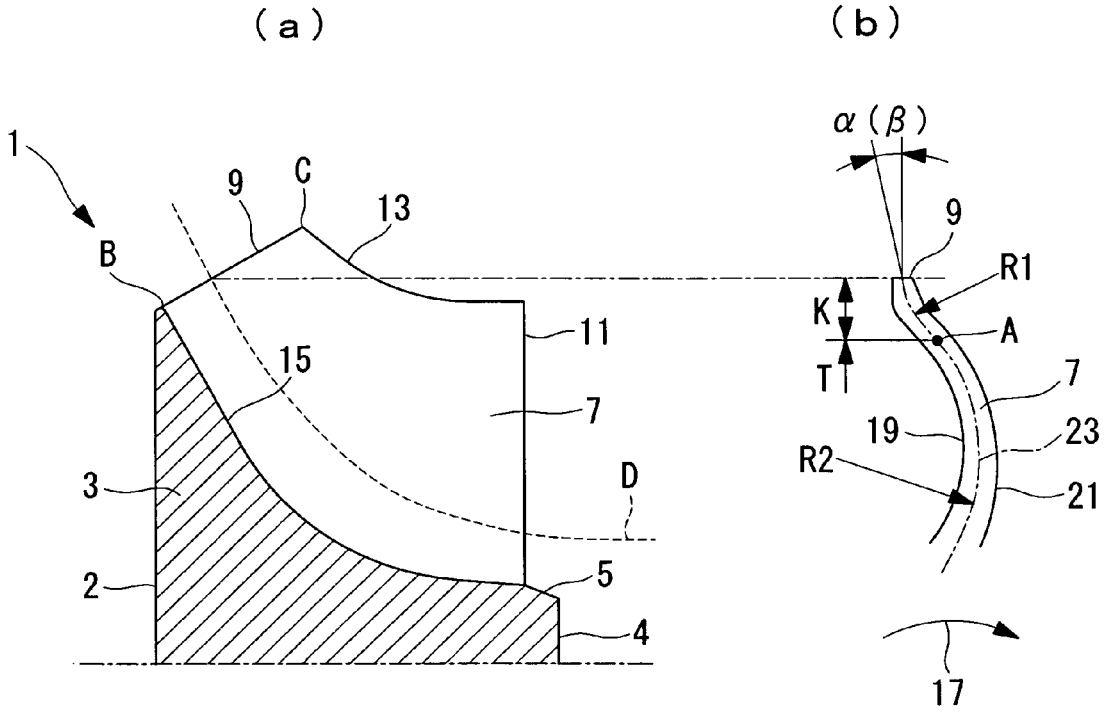
FIGs. 1(*a*) and (*b*) show a blade portion of a mixed flow turbine according to a first embodiment of the present invention, wherein FIG. 1(*a*) is a partial sectional view showing a meridional plane sectional surface, and FIG. 1(*b*) is a partial sectional view showing a sectional surface of the blade cut along an outer circumference surface of a hub.

1 Mixed flow turbine
2 Radial turbine
3 Hub
5 Outer circumference surface
7 Blade
9 Leading edge
11 Trailing edge
17 Rotational direction
19 Pressure surface
21 Suction surface
23 Camber line

25 Suction surface thickened section
27 Pressure surface thickened section
K Inflected section

DETAILED DESCRIPTION OF THE INVENTION

Hereinafter, embodiments according to the present invention are described, with reference to the drawings.

First Embodiment

Figure 7:
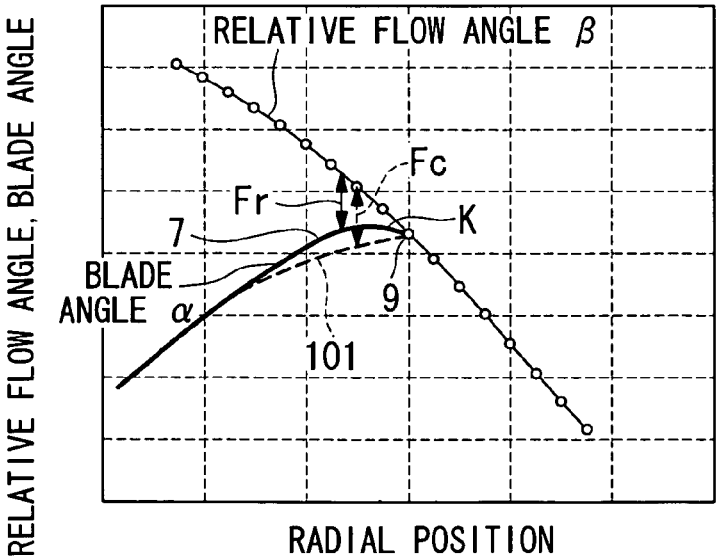
FIG. 7 is a graph showing the relationship between relative flow angle and blade angle.

Hereinafter, a mixed flow turbine 1 according to a first embodiment of the present invention is described, with reference to FIG. 1(*a*) through FIG. 7. This mixed flow turbine 1 is used in a turbocharger (turbocharger) for a diesel engine in a motor vehicle.

Figure 2:
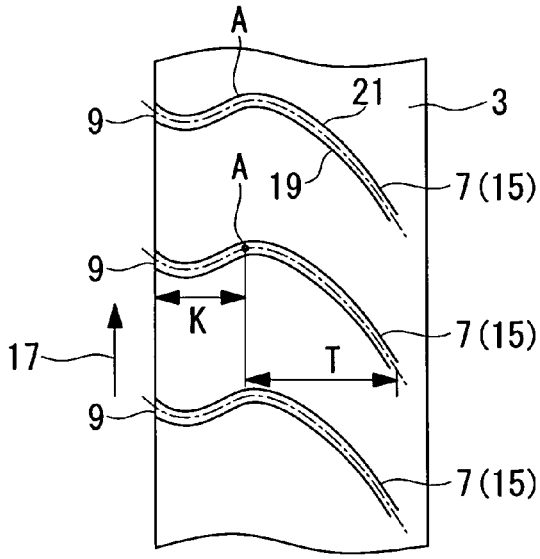
FIG. 2 is a developed partial projection view of the outer circumference surface of the hub according to the first embodiment of the present invention, projected onto a cylindrical surface.
Figure 3:
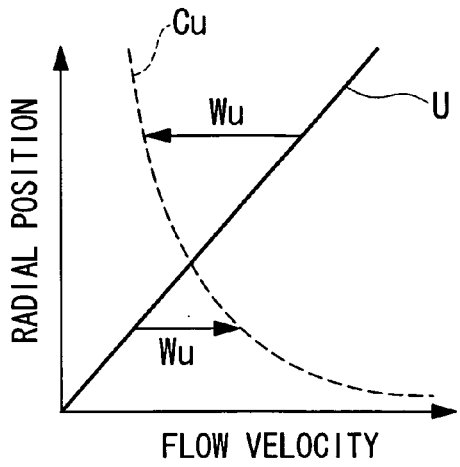

FIGS. 1(*a*) and (*b*) show a blade portion of the mixed flow turbine 1 of the present embodiment, wherein FIG. 1(*a*) is a partial sectional view showing a meridional plane sectional surface, and FIG. 1(*b*) is a partial sectional view showing a sectional surface of the blade cut along an outer circumference surface of a hub. FIG. 2 is a spread partial projection drawing of the outer circumference surface of the hub projected on a cylindrical surface.

The mixed flow turbine 1 is provided with a hub 3, a plurality of blades 7 provided at substantially equal intervals on an outer circumference surface 5 of the hub 3 in its circumferential direction, and a casing (not shown in the drawing).

The hub 3 is configured such that it is connected to a turbocompressor (not shown in the drawing) by a shaft, and a rotational driving force of the hub 3 rotates the turbocompressor to compress air and supply it to a diesel engine.

The outer circumference surface 5 of the hub 3 is of shape that smoothly connects a large diameter section 2 on one end side and a small diameter section 4 on the other end side, with a curved surface that is concaved toward the axial center.

The blade 7 is a plate shaped member and is provided in a standing condition on the outer circumference surface 5 of the hub so that a surface section of the blade 7 extends in the axial direction.

The hub 3 and the blade 7 are integrally formed by means of casting or machining. The hub 3 and the blade 7 may be separate bodies firmly fixed by means of welding or the like.

The blade 7 is configured such that in the region in which it rotates, combustion exhaust gas, which serves as a working fluid, is relatively introduced from the outer circumference on the large diameter section 2 side in roughly the radial direction.

The blade 7 has: a leading edge 9 positioned on the upstream side in the combustion exhaust gas flow direction; a trailing edge 11 positioned on the downstream side; an outside edge 13 positioned on the radial direction outside; an inside edge 15 positioned on the radial direction inside and connected to the hub 3; a pressure surface (upstream side outer surface) 19, which is a surface on the upstream side in the rotational direction 17; and a suction surface (downstream side outer surface) 21, which is a surface on the downstream side in the rotational direction 17.

An intersecting point C of the leading edge 9 and the outside edge 13 is positioned to the outside in the radial direction, of an intersecting point B of the hub 3 and the leading edge 9.

When seen on a cross-section D along the outer circumference surface 5, the blade 7 has a main body section T in which a camber line 23, which is a center line of the blade thickness, convex-curves in the rotational direction 17 (the center of a curvature radius R2 is positioned on the pressure surface 19 side), and an inflected section K in which the camber line 23 concave-curves in the rotational direction 17 (the center of a curvature radius R1 is positioned on the suction surface 21 side), on either side of an inflection point A.

In other words, for example, as shown in FIG. 2, the inside edge 15 of the blade 7 (section D along the outer circumference surface 5) is of elongated S shape when seen from the radial direction.

Since the section surface D follows the outer circumference surface 5, it follows the flow direction of the combustion exhaust gas, and the height in the radial direction gradually becomes lower.

Therefore, in the inflected section K, the rate of change toward the rotational direction becomes greater as the radial direction position becomes smaller, in other words, the inflected section K has a rate of change in the rotational direction.

The curvature centers R1 and R2 may respectively exist in a plurality of locations.

Operation of the mixed flow turbine 1 according to the above described present embodiment is described.

Combustion exhaust gas is introduced in a substantially radial direction from the outer circumference side of the leading edge 9 and travels between the blades 7 to be discharged through the trailing edge 11. At this time, the combustion exhaust gas pushes the pressure surface of the blade 7 to move the blade 7 in the rotational direction 17.

As a result, the hub 3 integrated with the blade 7 rotates in the rotational direction 17. The rotational force of the hub 3 rotates the turbocompressor. The turbocompressor compresses air and supplies the compressed air to the diesel engine.

At this time, the combustion exhaust gas is basically formed as a free vortex. Therefore, for example, the absolute circumferential direction velocity Cu is such that, with respect to a radial direction position (distance from the axial center) H0, Cu/H0 is constant, in other words, there is an inversely proportional relationship between them.

On the other hand, the peripheral velocity U of the blade 7 is proportional to the radial direction position H0. As a result, a relative circumferential flow velocity Wu occurs between the flow of the combustion exhaust gas and the blade 7.

Figure 4:
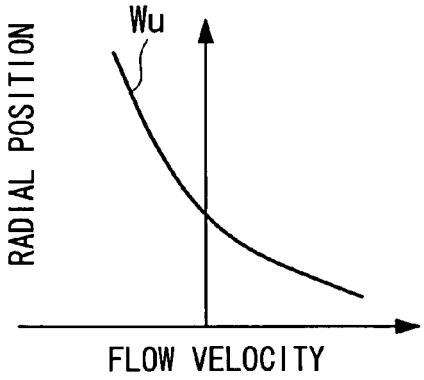
FIG. 4 is a graph showing variation in relative direction flow velocity in FIG. 3.

Plotting the relative circumferential flow velocity Wu against the radial position yields a curved line that is convex-curved downward (convex curved in the counter-rotational direction) as shown in FIG. 4. In other words, the rate of change toward the rotational direction 17 becomes greater as the radial direction position H0 becomes smaller, that is to say, there is a rate of change toward the rotational direction 17.

Figure 5:
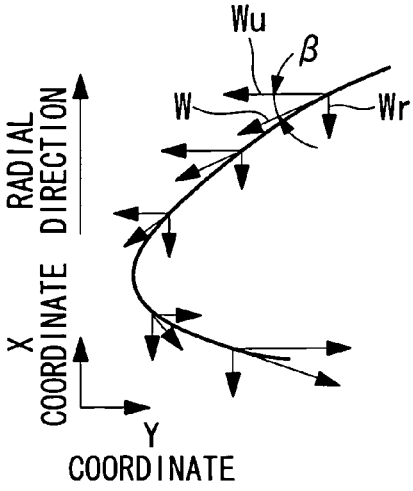
FIG. 5 is a schematic drawing showing a trajectory of changes in relative flow velocity W in the states in FIG. 3.

FIG. 5 schematically shows the changing trajectory of the relative flow velocity W at this time. The relative flow velocity W is a synthesis of the relative circumferential flow velocity Wu that changes according to FIG. 4, and the substantially constant relative radial velocity Wr. The change in the size of the relative flow velocity W has a trend similar to that of the relative circumferential flow velocity Wu shown in FIG. 4. In other words, it has a trend such that the rate of change toward the rotational direction 17 becomes greater as the radial direction position H0 becomes smaller (refer to FIG. 6).

The angle formed between the relative flow velocity W and the relative circumferential flow velocity Wu is a relative flow angle $\beta$ at that radial position.

Figure 6:
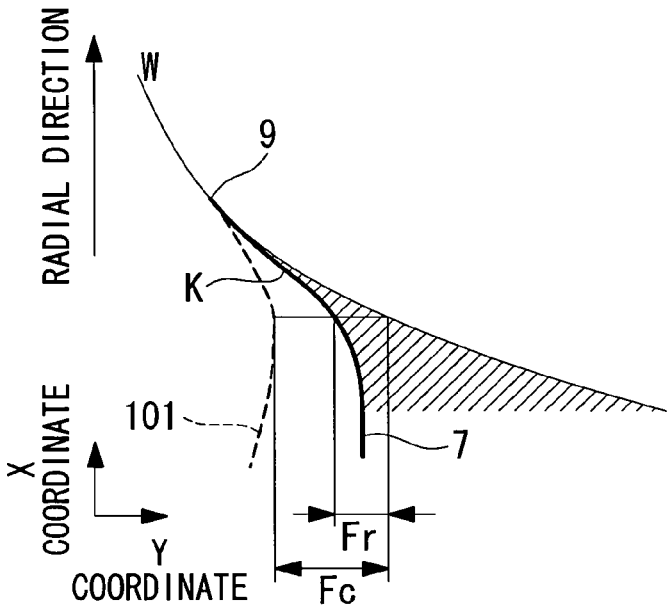
FIG. 6 is a graph showing relative flow velocity and states of load applied on the blade.

FIG. 6 shows the relative flow velocity W and states of the load on the blade 7. FIG. 7 shows a relationship between the relative flow angle $\beta$ and the blade angle $\alpha$.

In the present embodiment, the blade angle α in the leading edge 9 is aligned with the relative flow angle β in the radial direction position H0 of the leading edge 9. As a result, in the radial direction position H0, the leading edge 9 matches the relative flow velocity W in FIG. 6 and matches the relative angle β in FIG. 7.

In the present embodiment, since the inflected section K, in which the rate of change toward the rotational direction 17 becomes greater as the radial direction position H0 becomes smaller, is provided on the leading edge 9 side of the blade 7, the shape of the region between the leading edge 9 and the inflected section K changes substantially along the trajectory of the relative flow velocity W, the rate of change of which toward the rotational direction 17 becomes greater as the radial direction position H0 becomes smaller.

The distance between the trajectory of the relative flow velocity W and the blade 7 in FIG. 6 equates to a load Fr on the blade 7. This load Fr is significantly reduced compared to a load Fc in the case of a conventional blade 101 not having the inflected section K.

As described above, since there is provided the inflected section K, where the rate of change toward the rotational direction 17 becomes greater as the radial direction position H0 becomes smaller, the distance between the trajectory of the relative flow velocity W and the blade 7 can be made small and a rapid rise in the load Fr can be suppressed.

Accordingly, a rapid increase in the load Fr on the blade 7 in the leading edge 9 can be prevented, so that the occurrence of a leak flow from the pressure surface 19 side to the suction surface 21 side can be suppressed and incidence loss can be reduced.

At this time, if the curvature radius R1 of the inflected section K is set to follow the trajectory of the relative flow velocity W, incidence loss can be further reduced.

The blade angle α of the inflected section K becomes greater as the radial direction position H0 becomes smaller. On the other hand, the relative flow angle β also becomes greater as the radial direction position H0 becomes smaller.

Therefore, compared to the conventional blade 101 in which the blade angle α in the leading edge section becomes smaller as the radial direction position H0 becomes smaller, the blade angle α of the blade 7 changes to follow the trajectory of the relative flow angle β.

Since the difference between the relative flow angle β and the blade angle α in the radial direction position H0 equates to the load Fr, this load Fr is significantly reduced compared to the load Fc in the case of the conventional blade 101, which does not have the inflected section K.

As described above, the situation in which the above-mentioned effects are provided can also be explained from the relationship between the relative flow angle β and the blade angle α.

Figure 8:
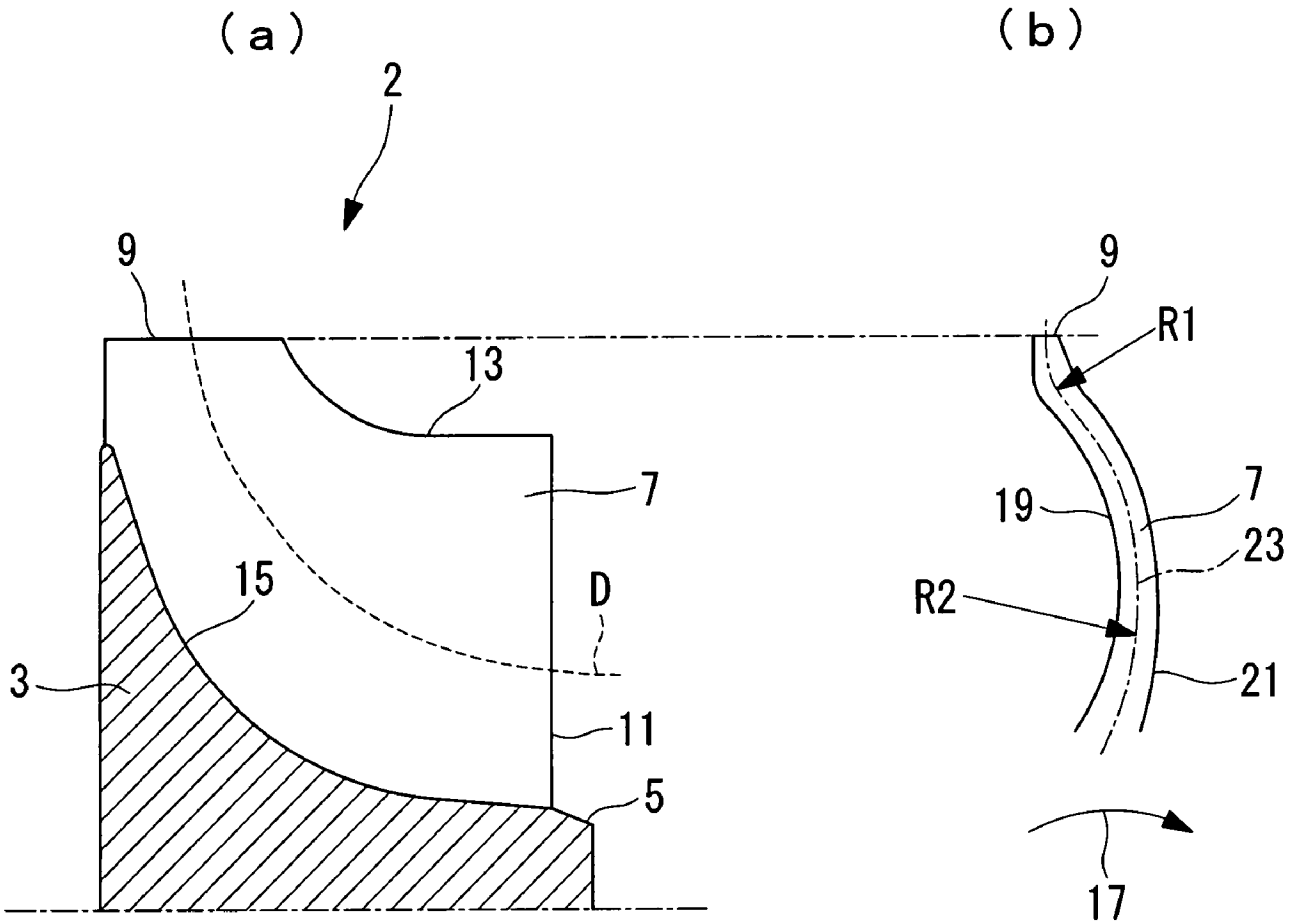
FIGs. 8(*a*) and (*b*) show a blade portion of a radial turbine according to another embodiment of the first embodiment of the present invention, wherein FIG. 8(*a*) is a partial sectional view showing a meridional plane sectional surface, and FIG. 8(*b*) is a partial sectional view showing a sectional surface of the blade cut along an outer circumference surface of a hub.

In the present embodiment, the present invention is described in application to a mixed flow turbine 1. However, it can also be applied to a radial turbine 2 as shown in FIGS. 8(*a*) and (*b*).

Second Embodiment

Figure 9:
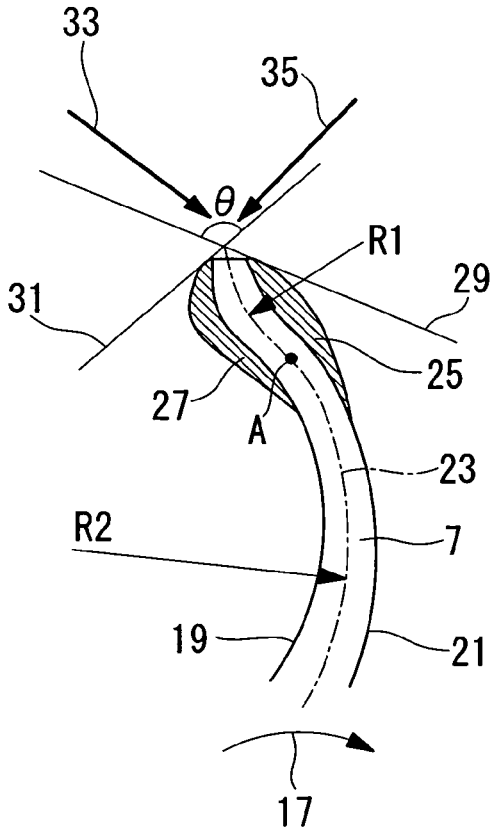
FIG. 9 is a partial sectional view showing a blade of a mixed flow turbine according to a second embodiment of the present invention, cut along an outer circumference surface of the hub.

Next, a second embodiment of the present invention is described, with reference to FIG. 9.

FIG. 9 is a partial sectional view of the blade 7 of a mixed flow turbine 1 cut on a section D along the outer circumference surface of the hub 3.

The mixed flow turbine 1 in the present embodiment differs from the one in the first embodiment in the configuration of the leading edge 9 section of the blade 7. Other constituents are the same as in the first embodiment mentioned above, and repeated descriptions of these are therefore omitted here.

The same reference symbols are given to members that are the same as in the first embodiment.

In the present embodiment, a suction surface thickened section 25 is provided on the suction surface 21 side of the leading edge 9 portion, and a pressure surface thickened section 27 is provided on the pressure surface 19 side. That is to say, the blade thickness of the leading edge 9 section is increased.

In FIG. 9, the suction surface thickened section 25 and the pressure surface thickened section 27 are shown as portions of increased blade thickness on the blade 7 of the first embodiment. However, they are not separate bodies from the blade 7.

The suction surface thickened section 25 and the pressure surface thickened section 27 are configured so as to respectively gradually increase from the leading edge 9 toward the downstream side and then to gradually decrease.

A tangent line 29 on the suction surface 21 side end section in the leading edge 9 intersects with a tangent line 31 on the pressure surface 19 side end section. The angle in this intersecting portion is referred to as a tangent line angle θ.

This tangent line angle θ is formed as a wide angle since the suction surface thickened section 25 and the pressure surface thickened section 27 are gradually increased.

For example, the temperature and pressure of the combustion exhaust gas change according to operating conditions of a motor vehicle. When the temperature and pressure of the combustion exhaust gas change, the theoretical velocity ratio U/C0 changes. As a result, the relative flow angle β of the combustion exhaust gas flowing to the leading edge 9 changes.

For example, a low U/C0 flow 33, the temperature and pressure of which are high and the theoretical velocity ratio U/C0 of which is low, tends to flow in from the upstream side of the rotational direction 17, while a high U/C0 flow 35, the temperature and pressure of which are low and the theoretical velocity ratio U/C0 is high, tends to flow in from the downstream side of the rotational direction 17.

In the case where a low U/C0 flow 33 such as is shown in FIG. 9, in which the relative flow angle β differs significantly from the blade angle α in the leading edge 9 of the camber line 23, flows in, with the conventional blade, there is a possibility of separation at the load pressure surface 21 side end section of the leading edge 9.

In the present embodiment, since an outer surface of the suction surface thickened section 25 has an angle greater than this relative flow angle β, this combustion exhaust gas can be made to travel along the outer surface of the suction surface thickened section 25 toward the flow direction downstream side.

Moreover, the suction surface thickened section 25 is such that the blade thickness gradually increases and then gradually decreases. As a result, combustion exhaust gas does not separate. Accordingly, the occurrence of collision loss due to collision of the combustion exhaust gas can be suppressed, and the incidence loss can be therefore reduced.

On the other hand, in the case where a high U/C0 flow 35 with a relative flow angle β that differs significantly from the blade angle α in the leading edge 9 of the camber line 23 shown in FIG. 9 flows in, with a conventional blade there is a possibility that it will separate at the pressure surface 19 side end section of the leading edge 9.

In the present embodiment, since an outer surface of the pressure surface thickened section 27 has an angle greater than this relative flow angle β, this combustion exhaust gas can be made to travel along the outer surface of the pressure surface thickened section 27 toward the flow direction downstream side.

Moreover, the pressure surface thickened section 27 is such that the blade thickness gradually increases and then gradually decreases. As a result, combustion exhaust gas does not separate. Accordingly, the occurrence of collision loss due to collision of the combustion exhaust gas can be suppressed, and incidence loss can be therefore reduced.

As described above, since the suction surface thickened section 25 and the pressure surface thickened section 27 are provided, even if the combustion exhaust has a relative flow angle β that is significantly different from the blade angle α in the camber line 23 in the leading edge 9, collision loss can be suppressed and incidence loss with respect to a wide range theoretical velocity ratio (U/C0) can therefore be reduced.

The suction surface thickened section 25 and the pressure surface thickened section 27 need only cover the range of changes of states of the combustion exhaust gas. Therefore, if this change range is narrow, either one of them may be provided alone, or the size of the tangent line angle θ may be made smaller.

In the present embodiment, the present invention is described in application to the mixed flow turbine 1. However it can also be applied to a radial turbine.

Third Embodiment

Figure 10:
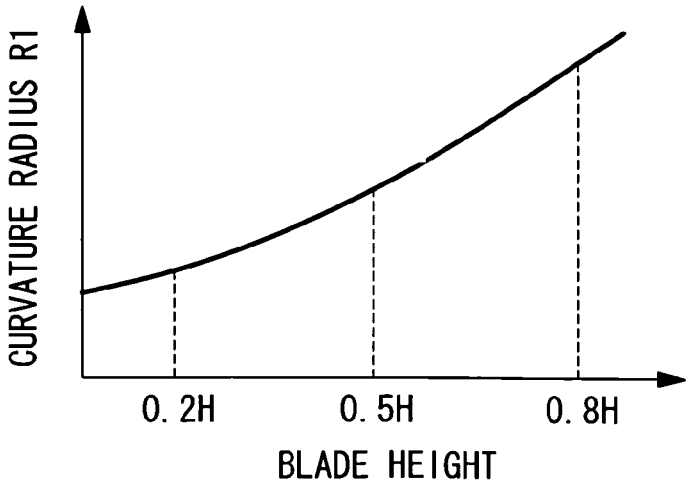
FIG. 10 is a graph showing changes in the curvature radius of the inflected section in the height direction of a blade of a mixed flow turbine according to a third embodiment of the present invention.
Figure 11:
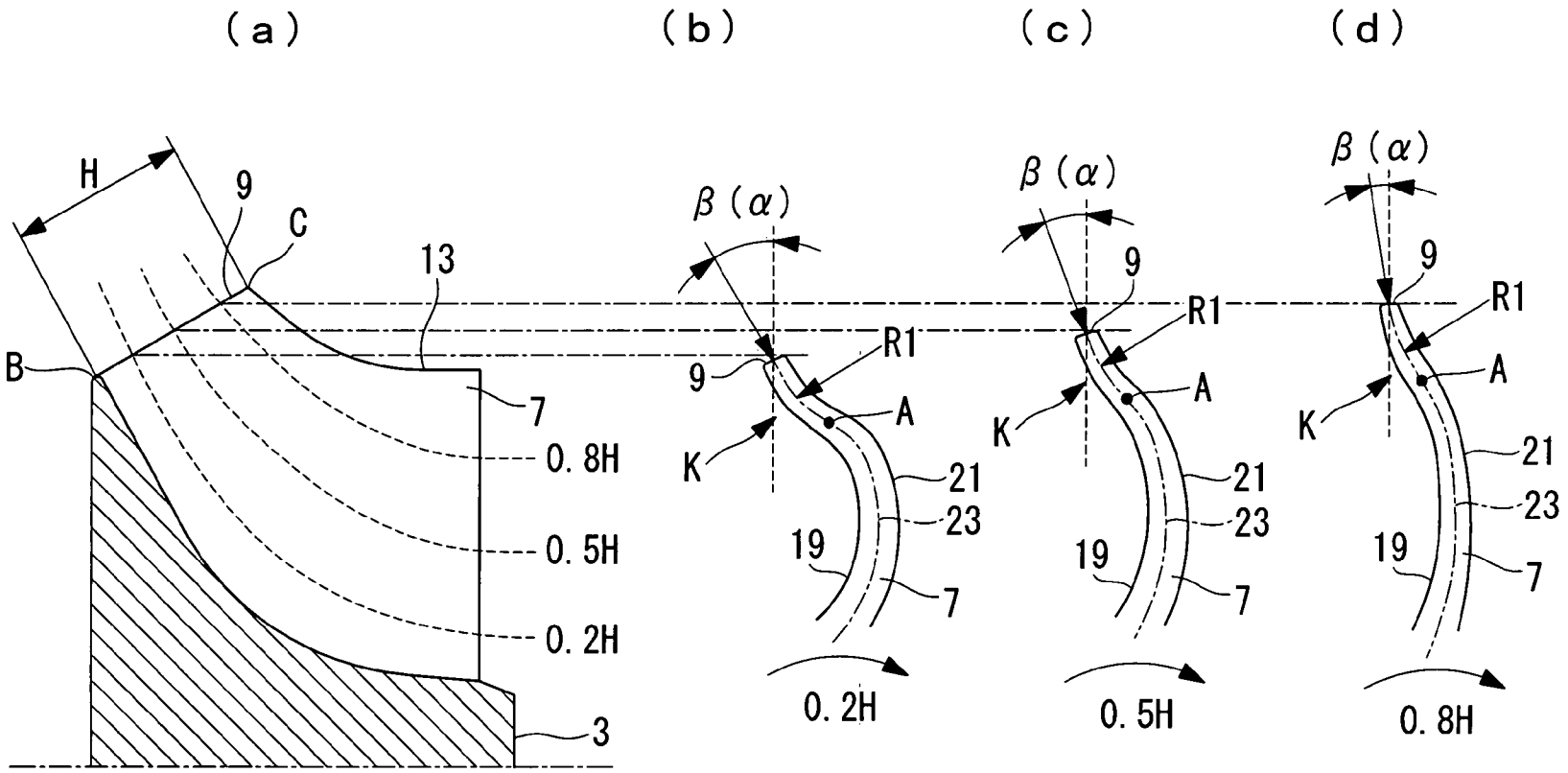
FIGs. 11(*a*)-(*d*) show a blade portion of a mixed flow turbine according to the third embodiment of the present invention, wherein FIG. 11(*a*) is a partial sectional view showing a meridional plane sectional surface, and FIGS. 11(*b*) through (*d*) are partial sectional views showing a sectional surface of the blade cut along an outer circumference surface of a hub, FIG. 11(*b*) showing a height position 0.2H, FIG. 11(*c*) showing a height position 0.5H, and FIG. 11(*d*) showing a height position 0.8H.
Figure 12:
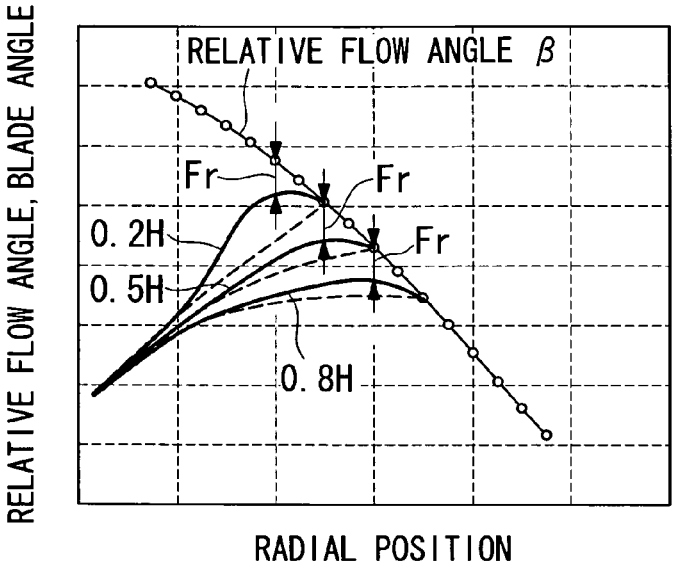
FIG. 12 is a graph showing a relationship between the relative flow angle and the blade angle of a mixed flow turbine according to the third embodiment of the present invention.
Figure 13:
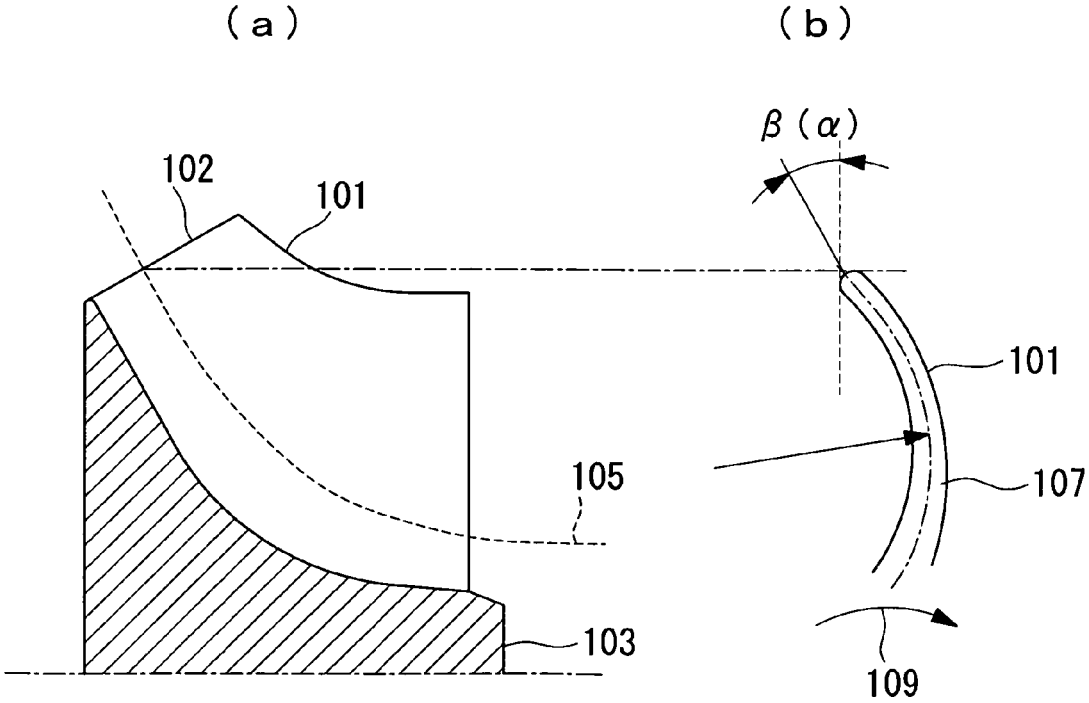
FIGs. 13(*a*) and (*b*) a blade portion of a conventional mixed flow turbine, wherein FIG. 13(*a*) is a partial sectional view showing a meridional plane sectional surface, and FIG. 13(*b*) is a partial sectional view showing a sectional surface of the blade cut along an outer circumference surface of a hub.

Next, a third embodiment of the present invention is described, with reference to FIG. 10 to FIG. 12.

FIG. 10 is a graph showing changes in the curvature radius R1 of the inflected section K in the height direction of the blade 7. FIGS. 11(*a*)-(*d*) show a blade portion of a mixed flow turbine of the present embodiment, wherein FIG. 11(*a*) is a partial sectional view showing a meridional plane sectional surface, and FIGS. 11(*b*) through (*d*) are partial sectional views showing a sectional surface of the blade 7 cut along an outer circumference surface of a hub 3, FIG. 11(*b*) showing a height position 0.2H, FIG. 11(*c*) showing a height position 0.5H, and FIG. 11(*d*) showing a height position 0.8H. FIG. 12 shows a relationship between the relative flow angle β and the blade angle α.

The mixed flow turbine 1 in the present embodiment differs from the one in the first embodiment in the configuration of the leading edge 9 section of the blade 7. Other constituents are the same as in the first embodiment mentioned above, and repeated descriptions of these are therefore omitted here.

The same reference symbols are given to members that are the same as in the first embodiment.

The present embodiment is configured such that, the curvature radius R1 of the camber line 23 in the inflected section K becomes greater. In other words, the curvature becomes smaller toward the outside edge 13 side (external diameter side) from the hub 3 side in the height direction of the blade 7 as shown in FIG. 10.

In the leading edge 9, the blade angle a thereof is matched with the relative flow angle βin the radial direction position thereof.

The blade angle α of the blade 7 changes to correspond to the trajectory of the relative flow angle β.

Since the difference between the relative flow angle β and the blade angle α in the radial direction position H0 equates to the load Fr, this load Fr is significantly reduced compared to the load Fc in the case of the conventional blade 101, which does not have the inflected section K.

The blade angle α of the inflected section K becomes greater as the radial direction position H0 becomes smaller. The ratio by which this blade angle becomes greater gets higher for a smaller curvature radius (greater curvature). Changes in the blade angle α of a smaller curvature radius (greater curvature) approach more closely to the trajectory of the relative flow angle β compared to changes of the blade angle α of a greater curvature radius (smaller curvature).

In other words, the inflected section K on the hub 3 side gets more significantly closer to the trajectory of the relative flow angle β than the inflected section K on the outside edge 13 side.

As shown in FIG. 10, this change occurs gradually and smoothly from the hub 3 side toward the outside edge 13 side.

On the other hand, the rate of change toward the rotational direction, of the relative flow velocity W becomes greater as the radial direction position becomes smaller. That is to say, because the relative flow angle β becomes greater, the radial direction position becomes smaller. That is to say, the relative flow angle β becomes greater the closer it is to the hub 3.

Therefore, the change in the blade angle α becomes more significantly close to the trajectory of the relative flow angle β on the hub 3 side where there is a greater relative flow angle β. As a result, the load on the blade surface can be reduced on the hub 3 side where the load is significant. Meanwhile, the load decrease rate gradually decreases toward the outside edge 13 side where load gradually decreases.

Therefore, the load Fr in the height direction of the blade 7 can be made substantially uniform. As a result, an incidence loss increase due to unbalanced load Fr can be suppressed.

Therefore, incidence loss can be reduced across the entire region in the height direction of the blade.

In the present embodiment, the present invention is described in application to the mixed flow turbine 1. However, it can also be applied to a radial turbine.

Furthermore, the configuration of the present embodiment and the configuration of the second embodiment may be provided together.

The invention claimed is:

1. A mixed flow turbine or a radial turbine comprising:

a hub; and a plurality of blades provided on an outer circumference surface of the hub at substantially equal intervals, each of the blades having a main section and an inflected section, the inflected section located at a leading edge side of the blade, wherein the main section of each of the blades is inflected such that a camber line at the main section is convex-curved towards a rotational direction side as seen in a direction of a rotational axis, wherein the inflected section of each of the blades is inflected such that a camber line at the inflected section in a sectional surface along the outer circumference surface of the hub is concave-curved against the rotational direction side as seen in the direction of the rotational axis, wherein a rate of change of the camber line at the inflected section towards a circumferential direction including turnover at the inflected section becomes greater as a radial direction position becomes smaller, and wherein the main section and the inflected section are located on opposite sides of an inflection point, the inflection point being located on a camber line of the blade closer to the leading edge side than a trailing edge side.

2. A mixed flow turbine or a radial turbine according to claim 1, wherein in a projection of the sectional surface of a leading edge section projected onto a virtual cylindrical surface which is coaxial with the rotational axis, an inflected section is inflected such that a camber line at the inflected section is concave-curved to the rotational direction side.

3. A mixed flow turbine or a radial turbine according to claim 1, wherein at least an upstream side outer surface and/or a downstream side outer surface in a rotational direction of the inflected section of each of the blades has a thickened section that smoothly increases a thickness of the blade from a leading edge of the blade.

4. A mixed flow turbine or a radial turbine according to claim 1, wherein the inflected section of each of the blades is configured so that a curvature of the camber line of a cross-section of the blade at the inflected section becomes smaller as the camber line at the inflected section gets closer to an outer diameter side of the blade along a leading edge of the blade from a hub side of the blade.

5. A mixed flow turbine or a radial turbine according to claim 2, wherein at least an upstream side outer surface and/or a downstream side outer surface in a rotational direction of the inflected section of each of the blades has a thickened section that smoothly increases a thickness of the blade from a leading edge of the blade.

6. A mixed flow turbine or a radial turbine according to claim 2, wherein the inflected section of each of the blades is configured so that a curvature of the camber line of a cross-section of the blade at the inflected section becomes smaller as the camber line at the inflected section gets closer to an outer diameter side of the blade along the leading edge of the blade from a hub side of the blade.

7. A mixed flow turbine or a radial turbine according to claim 3, wherein the inflected section of each of the blades is configured so that a curvature of the camber line of a cross-section of the blade at the inflected section becomes smaller as the camber line at the inflected section gets closer to an outer diameter side of the blade along the leading edge of the blade from a hub side of the blade.

8. A mixed flow turbine or a radial turbine according to claim 5, wherein the inflected section of each of the blades is configured so that a curvature of the camber line of a cross-section of the blade at the inflected section becomes smaller as the camber line at the inflected section gets closer to an outer diameter side of the blade along the leading edge of the blade from a hub side of the blade.

9. A mixed flow turbine or a radial turbine comprising:

a hub; and a plurality of blades provided on an outer circumference surface of the hub at substantially equal intervals, each of the blades having a main section and an inflected section, the inflected section located at a leading edge side of the blade, wherein the main section of each of the blades is inflected such that a camber line at the main section is convex-curved towards a rotational direction side as seen in a direction of a rotational axis, wherein the inflected section of each of the blades is inflected such that a camber line at the inflected section in a sectional surface along the outer circumference surface of the hub is concave-curved against the rotational direction side as seen in the direction of the rotational axis, wherein the main section and the inflected section are located on opposite sides of an inflection point, the inflection point being located on a camber line of the blade closer to the leading edge side than a trailing edge side, and wherein the inflected section of each of the blades is configured so that a curvature of the camber line of a cross-section of the blade at the inflected section becomes smaller as the camber line at the inflected section gets closer to an outer diameter side of the blade along a leading edge of the blade from a hub side of the blade.

10. A mixed flow turbine or a radial turbine comprising:

a hub; and a plurality of blades provided on an outer circumference surface of the hub at substantially equal intervals, each of the blades having a main section and an inflected section, the inflected section located at a leading edge side of the blade, wherein the main section of each of the blades is inflected such that a camber line at the main section is convex-curved towards a rotational direction side as seen in a direction of a rotational axis, wherein the inflected section of each of the blades is inflected such that a camber line at the inflected section in a sectional surface along the outer circumference surface of the hub is concave-curved against the rotational direction side as seen in the direction of the rotational axis, wherein the main section and the inflected section are located on opposite sides of an inflection point, the inflection point being located on a camber line of the blade closer to the leading edge side than a trailing edge side, wherein in a projection of the sectional surface of a leading edge section projected onto a virtual cylindrical surface which is coaxial with the rotational axis, an inflected section is inflected such that a camber line at the inflected section is concave-curved to the rotational direction side, and wherein the inflected section of each of the blades is configured so that a curvature of the camber line of a cross-section of the blade at the inflected section becomes smaller as the camber line at the inflected section gets closer to an outer diameter side of the blade along a leading edge of the blade from a hub side of the blade.

11. A mixed flow turbine or a radial turbine comprising:

a hub; and a plurality of blades provided on an outer circumference surface of the hub at substantially equal intervals, each of the blades having a main section and an inflected section, the inflected section located at a leading edge side of the blade, wherein the main section of each of the blades is inflected such that a camber line at the main section is convex-curved towards a rotational direction side as seen in a direction of a rotation axis, wherein the inflected section of each of the blades is inflected such that a camber line at the inflected section in a sectional surface along the outer circumference surface of the hub is concave-curved against the rotational direction side as seen in the direction of the rotational axis, wherein the main section and the inflected section are located on opposite sides of an inflection point, the inflection point being located on a camber line of the blade closer to the leading edge side than the trailing edge side, wherein at least an upstream side outer surface and/or a downstream side outer surface in the rotational direction of the inflected section of each of the blades has a thickened section that smoothly increases a thickness of the blade from a leading edge of the blade, and wherein the inflected section of each of the blades is configured so that a curvature of the camber line of a cross-section of the blade at the inflected section becomes smaller as the camber line at the inflected section gets closer to an outer diameter side of the blade along the leading edge of the blade from a hub side of the blade.

12. A mixed flow turbine or a radial turbine comprising:

a hub; and a plurality of blades provided on an outer circumference surface of the hub at substantially equal intervals, each of the blades having a main section and an inflected section, the inflected section located at a leading edge side of the blade, wherein the main section of each of the blades is inflected such that a camber line at the main section is convex-curved towards a rotational direction side as seen in a direction of a rotational axis, wherein the inflected section of each of the blades is inflected such that a camber line at the inflected section in a sectional surface along the outer circumference surface of the hub is concave-curved against the rotational direction side as seen in the direction of the rotational axis, wherein the main section and the inflected section are located on opposite sides of an inflection point, the inflection point being located on a camber line of the blade closer to the leading edge side than a trailing edge side, wherein in a projection of the sectional surface of a leading edge section projected onto a virtual cylindrical surface which is coaxial with the rotational axis, an inflected section is inflected such that the camber line at the inflected section is concave-curved to the rotational direction side, wherein at least an upstream side outer surface and/or a downstream side outer surface in a rotational direction of the inflected section of each of the blades has a thickened section that smoothly increases a thickness of the blade from a leading edge of the blade, and wherein the inflected section of each of the blades is configured so that a curvature of the camber line of a cross-section of the blade at the inflected section becomes smaller as the camber line at the inflected section gets closer to an outer diameter side of the blade along the leading edge of the blade from a hub side of the blade.

* * * * *